United States Patent [19]

Tengs et al.

[11] Patent Number: 4,612,219

[45] Date of Patent: Sep. 16, 1986

[54] INVISIBLE CHRISTMAS TREE

[76] Inventors: Anthony M. Tengs, 2001 Dexter Ave. N., Seattle, Wash. 98109; Edna M. Gilbert, 6105 Camelback Manor Dr., Paradise Valley, Ariz. 85253

[21] Appl. No.: 780,262

[22] Filed: Sep. 26, 1985

[51] Int. Cl.[4] ..... A47G 33/06

[52] U.S. Cl. ..... 428/8; 428/11; 428/18; 428/542.6; D11/118; D11/141

[58] Field of Search ..... 428/7, 11, 18, 19, 20, 428/8, 542.6; D11/118, 124, 141

[56] References Cited

U.S. PATENT DOCUMENTS

| | | | |
|---|---|---|---|
| D. 210,598 | 3/1968 | Kadmon et al. | D11/141 X |
| D. 213,982 | 4/1969 | Simon | D11/141 X |
| D. 218,689 | 9/1970 | Johnson, Jr. | D11/118 X |
| D. 236,216 | 8/1975 | Fred | 428/18 X |
| D. 276,322 | 11/1984 | Maxwell et al. | D11/118 |
| 2,714,776 | 8/1955 | Lee | 428/7 X |
| 3,578,105 | 5/1971 | Griff | 428/11 X |
| 3,677,867 | 7/1972 | Westlund | 428/20 X |
| 3,704,366 | 11/1972 | Korb et al. | 428/18 X |
| 3,723,723 | 3/1973 | Lerner | 428/18 X |
| 3,770,951 | 11/1973 | Corelli | 362/123 X |
| 4,011,674 | 3/1977 | Jacobson | D11/118 X |
| 4,143,199 | 3/1979 | Bardon et al. | 428/4 X |
| 4,279,090 | 7/1981 | Shofner et al. | 428/7 X |
| 4,366,199 | 12/1982 | Grosjean | 428/4 X |

*Primary Examiner*—Henry F. Epstein
*Attorney, Agent, or Firm*—Christensen, O'Connor, Johnson & Kindness

[57] ABSTRACT

A mobile-type Christmas tree (10) conveying the impression of Christmas ornaments (13) hung upon an invisible coniferous tree is disclosed. The mobile (10) includes an overhead support (11), and a multiplicity of filaments (12) depending from the overhead support (11). A multiplicity of ornaments (13) are attached to the filaments (12). The above ornament length of the filaments (12) increases in outward radial progression from the center of the overhead support (11) so that the ornaments (13) are supported in spaced locations such that the peripheral ornaments define the invisible tree's branches and, thus, the shape of the tree.

16 Claims, 6 Drawing Figures

INVISIBLE CHRISTMAS TREE

TECHNICAL FIELD

The present invention pertains to a mobile-type Christmas tree that is uniquely configured to simulate the appearance of an ornament-laden coniferous tree wherein the tree itself is invisible.

BACKGROUND ART

Through widespread custom and usage, the coniferous tree has become the primary symbol of the Christmas holiday season. While both natural and artificial trees remain the popular choice, various arrangements have been devised to satisfy the demands of persons desiring to display this symbol of the holiday season without the necessity of using an actual tree. Among these arrangements are Christmas tree mobiles that are suspended from a ceiling support. Typically, these mobiles are conically-shaped to simulate the shape of an actual tree, and are constructed in such a manner that Christmas ornaments can be hung thereon. Exemplary embodiments of such Christmas tree mobiles are disclosed in U.S. Design Pat. Nos. 236,216 and 276,322.

While the branches of both natural and artificial coniferous trees form an envelope that generally resembles a cone, the individual branches themselves are usually quite irregular with regard to their position, spacing and orientation along the tree trunk. Moreover, the individual branches are usually quite irregular in terms of their length, shape and fullness. These irregularities contribute to making each tree somewhat unique. Christmas tree mobiles of the type shown in the aforementioned patents also define conical envelopes. These mobiles are, however, incapable of simulating the irregular appearance of an actual tree because of their highly symmetrical construction. Consequently, such Christmas tree mobiles are characteristically unnatural in appearance, a feature that detracts from their appeal.

SUMMARY OF THE INVENTION

According to this invention, the illusion of an invisible coniferous tree is provided by a Christmas tree mobile including an overhead support, and a multiplicity of elongate elements that are each suitable for supporting one or more Christmas ornaments. The elongate elements are each attached to and depend from the overhead support in a manner such that they can in turn support ornaments positioned at spaced locations corresponding to the random positioning of ornaments supported by the branches of a coniferous tree. The points of attachment radiate outwardly from the center of the overhead support. Because of the generally conical shape exhibited by an actual coniferous tree, the above-ornament length of each elongate element tends to increase with outward radial progression. Consequently, the peripheral ornaments supported by the elongate elements present the appearance of having been hung on the tips of randomly dispersed invisible branches. Preferably, the elongate elements comprise transparent filaments that are invisible, or nearly so, to the naked eye. This results in a particularly distinctive and attractive Christmas tree mobile wherein the transparency of the filaments serves to heighten the illusion of an invisible tree because the ornaments appear to float in space without any visible means of support.

In accordance with another aspect of the invention, the overhead support comprises a plurality of support arms extending radially outward from the peripheral edge of a central hub. The elongate elements are attached to the overhead support at spaced-apart points located along the length of the support arms. The length of each elongate element can be the same or determined by the distance of its point of attachment from the center of the central hub. Preferably, the central hub has a star shaped configuration.

In accordance with an alternative aspect of this invention, the overhead support comprises a plurality of concentric rings that are supported in substantially coplanar alignment. The elongate elements are attached to the overhead support at predetermined locations along each ring. Preferably, the rings surround a central hub having a star shaped configuration.

In accordance with another aspect of the present invention, the overhead support may include a light reflective surface on the side thereof facing the ornaments. The reflective surface further heightens the illusion that the ornaments are floating in space.

In accordance with still another aspect of this invention, the ornaments are attached to the elongate elements by a position adjustment device that allows the position of the ornaments to be adjusted or changed. As a result, the configuration of the invisible Christmas tree can be adapted to the needs of each environment. In some cases the tree may be short and fat. In others, it may be tall and thin. Preferably, the adjustment device comprises a split ring mounted such that the elongate elements lie in the plane of the ring and pass through the slit. The ornaments are hung from one of the two thusly formed sectors. The split ring clamp force is adequate to support the weight of most ornaments without the ring sliding.

BRIEF DESCRIPTION OF THE DRAWINGS

So that the present invention is more clearly understood, reference is now made to the several accompanying drawings wherein like reference numerals refer to like parts throughout the several views, and wherein.

DETAILED DESCRIPTION OF THE PREFERRED EMBODIMENTS

Figure 1:
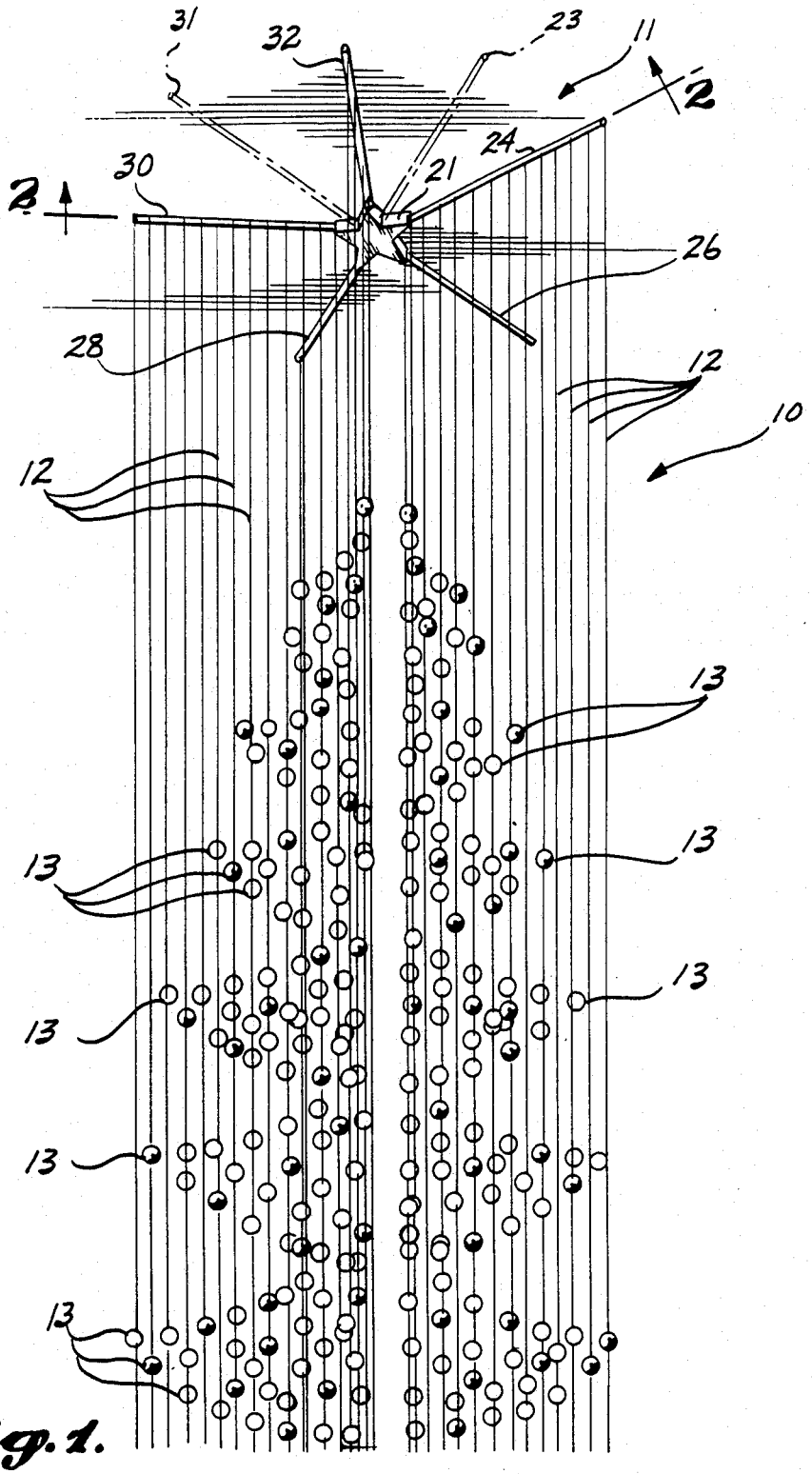
FIG. 1 is a perspective view of the preferred embodiment of the present invention.

Referring now to the drawings, and in particular to FIG. 1, there is shown the preferred embodiment of a Christmas tree mobile 10 constructed in accordance with the present invention. The mobile 10 includes an overhead support 11, and a multiplicity of filaments 12 attached to and depending from the overhead support 11. A multiplicity of ornaments 13 are hung from the filaments 12. Either a single ornament or several ornaments are hung from each filament.

Figure 3:
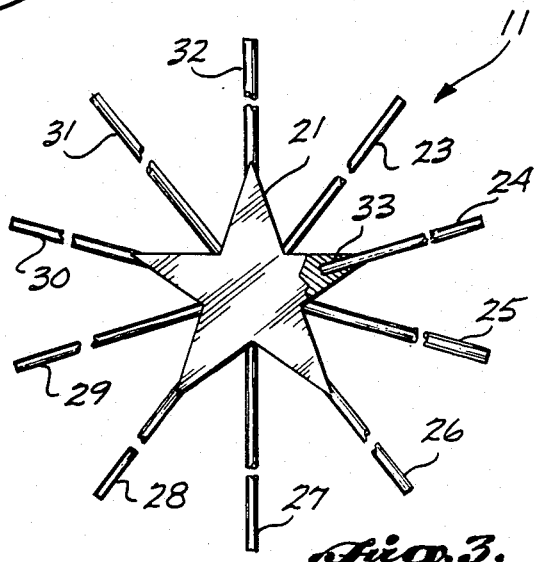
FIG. 3 is a plan view of the overhead support 11 shown in FIG. 1.

The overhead support 11 of the preferred embodiment is illustrated in greater detail in FIG. 3. More particularly, the overhead support 11 comprises a central hub in the shape of a five sided star 21 and ten radial struts 23 through 32. Preferably, the hub and the radial struts are both formed of clear acrylic plastic. Five of the radial struts are attached to the points of the star and five are attached to the valleys. Preferably, the struts are attached to the star by mounting the ends of the struts in cavities 33 formed in the star. The star 21 and the radial struts all lie in a common plane. For ease of illustration, only the struts attached to the points of the star are shown in FIG. 1. It is to be understood that struts can be added to the valleys, as shown in FIG. 3, if desired. Further, the star can have more or less than five points, if desired. An eight point star is particularly desirable in some embodiments of the invention.

Figure 4:
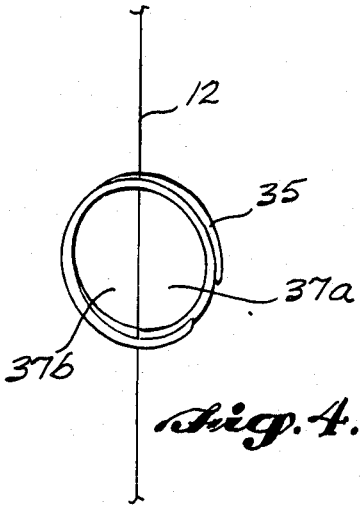
FIG. 4 is an enlarged view of a mechanism for attaching ornaments to the elongate elements forming part of the invention.

The filaments 12 may be either permanently or detachably secured to the overhead support 11 by any suitable means, such securement means not forming an integral part of this invention. The preferred device for attaching the ornaments 13 to the filaments 12 is illustrated in FIG. 4. The attachment device comprises a split ring 35 of the type used to attach fishing devices and other mechanical elements together. As is well known, such rings are split in the plane of the ring. In accordance with the invention, split rings are mounted on the filaments such that the filaments pass through the split on the opposite sides of the rings. The spring force of the ring clamps onto the filament in a tight, but slidable, manner. Ornaments are hung from one of the resulting sectors 37*a* and *b* using conventional ornament hooks. Alternatively, if fixed ornament positions are acceptable in an actual embodiment of the invention, simply knotting the filament into loops can be used as a way of hanging ornaments.

An important and characterizing feature of this invention concerns the positioning and length of each of the above ornament portions of the filaments 12. As will be noted in FIG. 1, the length of the above ornament length of the filaments 12 progressively increases with outward radial progression from the center of the overhead support 11.

Figure 2:
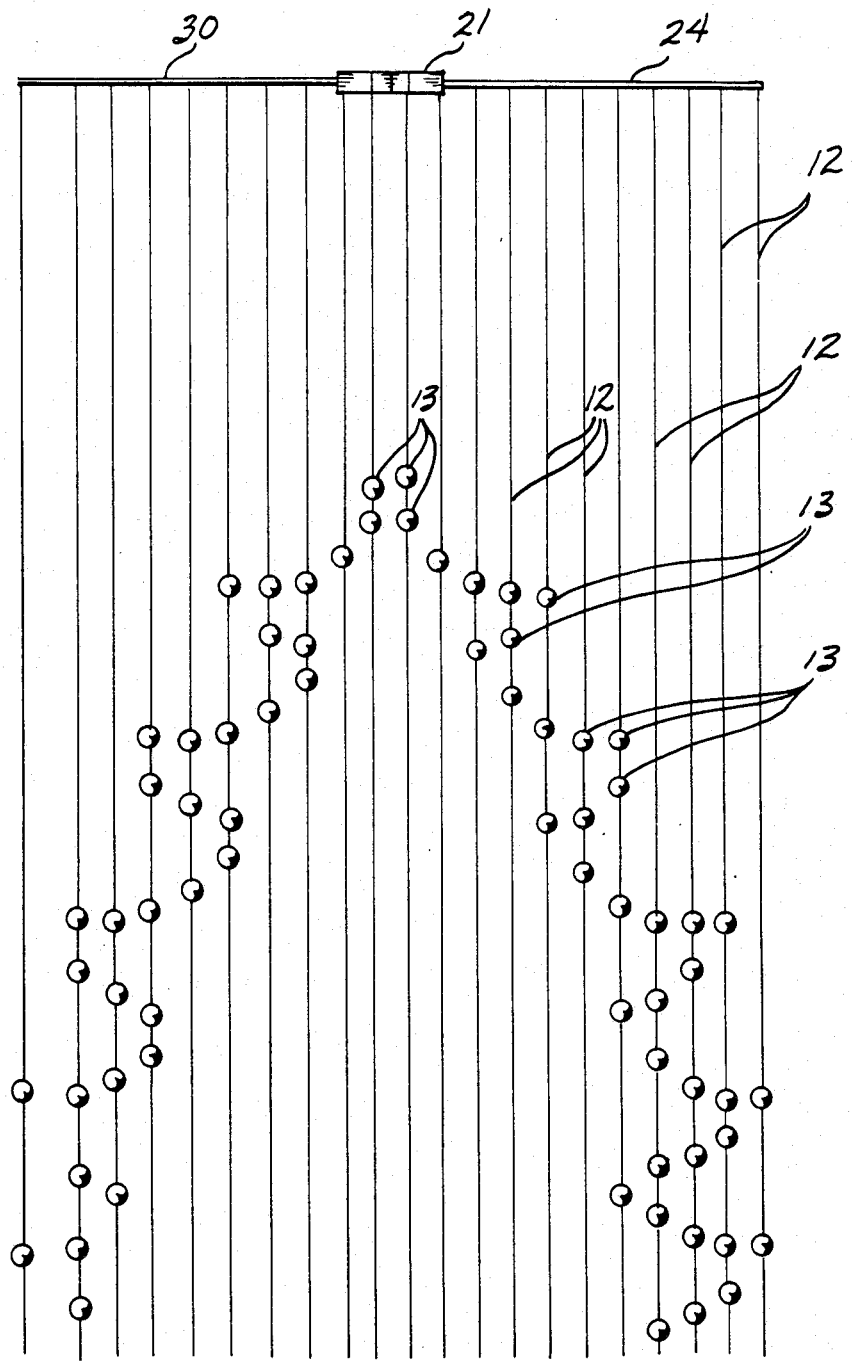
FIG. 2 is a cross-sectional plane view taken along line 2—2 of FIG. 1.

The foregoing feature will be more clearly understood by referring to FIGS. 1 and 2 simultaneously. More particularly, a filament 12 is attached to the center of the star 21. This filament extends downwardly therefrom a preselected distance so as to support a top ornament 13 in a position that defines the apex of an invisible Christmas tree. The remainder of this invisible tree is formed by first determining the desired location for the tips of each tree branch. The position of the ornaments along the length of the filaments 12 attached to the radial struts 23 through 32 are then individually adjusted such that the peripheral ornaments define the branches of an invisible Christmas tree in much the same way ornaments hung from the branches of a coniferous tree define the shape of the tree.

A Christmas tree mobile 10 constructed in accordance with this invention is completed by attaching additional ornaments 13 to each of the filaments 12. By virtue of the position and length of each of the filaments 12, the ornaments 13 distinctively, and in a very aesthetically pleasing manner, convey the immediate impression of a Christmas tree wherein the tree itself is invisible.

In its presently preferred form, the filaments 12 of the preferred embodiment comprise transparent filaments of plastic that, insofar as possible, are invisible to the naked eye. This heightens the illusion of an invisible Christmas tree since the ornaments 13 appear to float in space without any visible means of support therefor. Filament transparency is, however, a feature that is not considered as limiting of the invention. The filaments 12 can easily take many various forms such as, for example, colored/multi-colored filaments, ribbons of fabric, plastic or metallic foil, etc. Moreover, some or all of the filaments 12 may be formed from light transmissive, fiber optic material. In this regard, the filaments 12 would be connected in a conventional manner through conventional optical couplings to a light generator (not shown) that would control both the hue and brightness of the fiber optic filaments.

The ornaments 13 are illustrated in FIG. 1 as individual spheres. This is, of course, not to be considered limiting of the invention in view of the wide variety of ornaments available as Christmas decorations.

In its typical setting it is anticipated that the mobile 10 will be suspended from the ceiling of a room. It is, however, equally practicable to attach a wall bracket projecting outwardly from a wall, and then to suspend the mobile 10 from the wall bracket. Moreover, in situations where the space in a room is limited, a mobile embodying the characterizing features of this invention can easily be produced that describes less than a full tree. For example, the overhead support 11 can be readily constructed in semi-circular form to thus produce only one-half of a tree. This modified form of the invention would then be mounted flush on a wall to take up less room space. Further, the adjustability aspect allows the tree shape to be configured to fit the available space or desires of the user, i.e., the tree can have a short, fat shape or a tall, thin shape.

Figure 5:
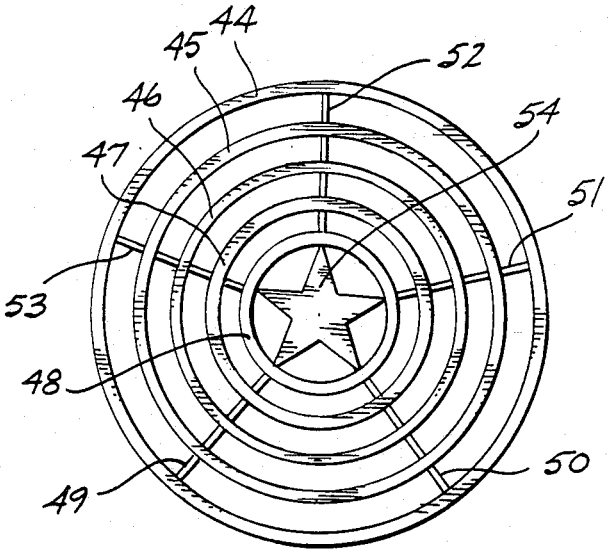
FIG. 5 is a partial, cut-away, plan view of an alternative embodiment of the overhead support; and, FIG. 6 is a cut-away, perspective view of another form of the present invention wherein the overhead support shown in FIGS. 1 and 2 includes a light reflector mounted across the downwardly-facing side thereof.

The overhead support 11 of the preferred embodiment may take varius other forms. For example, as shown in FIG. 5, the overhead support may comprise a plurality of concentric support rings 44, 45, 46, 47 and 48 that are rigidly supported in coplanar alignment by a plurality of radial struts 49, 50, 51, 52 and 53. The radial struts 49 through 53 are each attached at one end thereof to the innermost support ring 48 and at the opposite end thereof to the outermost support ring 44. The radial struts 49 through 53 are likewise attached to the intermediate support rings 45, 46 and 47 to provide support therefor. Preferably, the overhead support includes a central hub 54 in the form of a five-point star that is attached to the innermost support ring 48. The points of the star forming the hub 54 are radially aligned with the radial struts 49 through 53.

Figure 6:
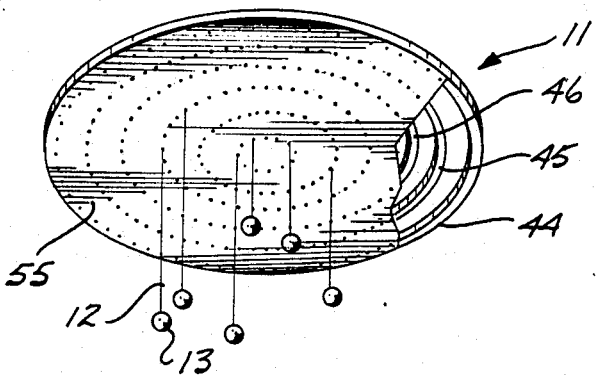

Turning now to FIG. 6, therein is illustrated a further alternate form of the overhead support 11 of the present invention wherein a light reflector 55 is secured to the overhead support on the side thereof facing the ornaments 13. A plurality of small perforations are provided through the reflector 55 so that the filaments 12 can be attached to the support rings of the overhead support 11. Alternatively, the filaments 12 can be attached directly to the reflector 55 if it is sufficiently rigid to support the filaments at their respective points of attachment. The reflector 55 may be selected from a wide variety of materials. However, it is presently preferred that the reflector 55 comprise a flexible sheet of heavily metalized Mylar that is stretched tautly across the overhead support 11 and attached thereto by any suitable means.

In view of the foregoing, it will be appreciated that disclosed herein is a Christmas tree mobile that immediately and distinctly conveys the impression of an invisible Christmas tree having ornaments hung upon the branches thereof. The ability to adjust the position and length of the individual ornaments makes it possible to produce a Christmas tree mobile that closely mimics the irregularities and shape associated with natural and aritificial coniferous trees. Because of its adjustability, the invisible Christmas tree is usable in a high ceiling room as well as a low ceiling room. Because the tree is "invisible", maximum ornament exposure is provided. Further, because the overhead support and the filaments are "collapsible" the invention is easily stored when not in use.

While the present invention has been disclosed with regard to the presently preferred embodiments thereof, it will be understood that various changes, rearrangements and modifications can be made thereto without departing from the essence and scope of the invention as defined in the appended claims. Accordingly, it is intended that the present disclosure not be interpreted in a limiting sense and that obvious variants of the invention are comprehended to be within its essence and scope.

The embodiments of the invention in which an exclusive property or privilege is claimed are defined as follows:

1. A Christmas tree mobile conveying the impression of an invisible coniferous tree, comprising:

(a) an overhead support member; and, (b) a multiplicity of elongate elements attached to said overhead support member at spaced apart points so has to hang vertically from said overhead support member at spaced apart locations, each of said elongate elements including one or more attachment means for hanging ornaments from said elongate elements such that the ornaments define the tips of the branches of an invisible coniferous tree and, thus, the periphery of the tree.

2. A Christmas tree mobile as set forth in claim 1, wherein said attachment means are separate elements slidably mounted on said elongate elements.

3. A Christmas tree mobile as set forth in claim 2, wherein said separate attachment means are split rings.

4. A Christmas tree mobile as set forth in claim 1, wherein said overhead support member includes a central hub having a plurality of support arms extending radially outward from the periphery thereof.

5. A Christmas tree mobile as set forth in claim 4, wherein the periphery of said central hub has a star shape.

6. A Christmas tree mobile as set forth in claim 5, wherein said attachment means are separate elements slidably mounted on said elongate elements.

7. A Christmas tree mobile as set forth in claim 6, wherein said separate attachment means are split rings.

8. A Christmas tree mobile as set forth in claim 1, wherein said overhead support member comprises a plurality of concentric support rings and a central hub supported in substantially coplanar alignment.

9. A Christmas tree mobile as set forth in claim 8, wherein the periphery of said central hub has a star shape.

10. A Christmas tree mobile as set forth in claim 9, wherein said attachment means are separate elements slidably mounted on said elongate elements.

11. A Christmas tree mobile as set forth in claim 10, wherein said separate attachment means are split rings.

12. A Christmas tree mobile as set forth in claim 1, wherein said elongate elements comprise a multiplicity of filaments.

13. A Christmas tree mobile as set forth in claim 12, wherein said filaments are transparent.

14. A Christmas tree mobile as set forth in claim 12, wherein at least one of said filaments comprises a fiber optic filament.

15. A Christmas tree mobile as set forth in claim 1, wherein said elongate elements comprise a multiplicity of ribbons.

16. A Christmas tree mobile as set forth in claim 1, wherein said overhead support member includes a light reflecting surface on the downwardly-facing side thereof.

* * * * *